United States Patent [19]

Kamitakahara et al.

[11] Patent Number: 4,840,879

[45] Date of Patent: Jun. 20, 1989

[54] DIRECT POSITIVE IMAGE-FORMING PROCESS

[75] Inventors: Atushi Kamitakahara; Keiji Ogi, both of Hino, Japan

[73] Assignee: Konishiroku Photo Industry Co., Ltd., Tokyo, Japan

[21] Appl. No.: 153,519

[22] Filed: Jan. 29, 1988

Related U.S. Application Data

[63] Continuation of Ser. No. 846,845, Apr. 1, 1986, abandoned, which is a continuation of Ser. No. 693,794, Jan. 23, 1985, abandoned, which is a continuation of Ser. No. 457,490, Jan. 12, 1983, abandoned.

[30] Foreign Application Priority Data

Jan. 12, 1982 [JP] Japan ..... 57-22507

[51] Int. Cl.[4] ..... G03C 5/24; G03C 7/16

[52] U.S. Cl. ..... 430/406; 430/378; 430/409; 430/940

[58] Field of Search ..... 430/378, 409, 940, 406

[56] References Cited

U.S. PATENT DOCUMENTS

| | | | |
|---|---|---|---|
| 3,733,198 | 5/1973 | Vanreusel et al. | 430/378 |
| 4,268,621 | 5/1981 | Ogi et al. | 430/378 |
| 4,395,478 | 7/1983 | Hoyen | 430/378 |

*Primary Examiner*—Mukund J. Shah

*Attorney, Agent, or Firm*—Jordan B. Bierman

[57] ABSTRACT

The present invention relates to a process for forming a direct positive color image comprising (a) imagewise exposing a direct positive photosensitive silver halide color photographic material to light to yield an imagewise exposed material, said photographic material having a support and at least one silver halide emulsion layer thereon, said emulsion layer containing a coupler and internal latent image type silver halide crystals whose surfaces have not been fogged prior to said imagewise exposure, and (b) uniformly exposing to light the entire surface of said imagewise exposed photographic material before or during a development step and in the presence of a substance of Formula IV, a compound of formula I and a color-developing agent consisting of aromatic primary amino compounds selected from the group consisting of N-methylaminophenol, 4-amino-3-methyl-N-ethyl-N-(-methanesulfonamidoethyl) aniline,4-amino-3-methyl-N-ethyl-N-(-hydroxyethyl) aniline, 4-amino-3-methyl-N, N-diethyl-p-phenylenediamine, and 4-amino-3-methyl-N-ethyl-N- -methoxyethyl-p-phenylenediamine; wherein the oxidized products thereof form a coupling reaction with said couplers to produce dyes,

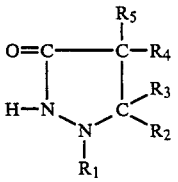

I wherein $R_1$ is selected from hydrogen, alkyls of 1 to 4 carbon atoms which are substituted or unsubstituted, and aryls which are substituted or unsubstituted; $R_2$–$R_5$ are individually selected from the same group as $R_1$ and hydroxyl;

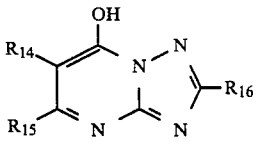

IV wherein $R_{14}$ and $R_{15}$ are individually selected from hydrogen, alkyls having 1 to 4 carbon atoms which may be substituted or unsubstituted, aryl groups which may be substituted or unsubstituted and non-metal atoms necessary for linking $R_{14}$ and R15 in such a manner as to create a 5 or 6 membered ring, and $R_{16}$ is selected from hydrogen, alkyls having 1 to 4 carbon atoms which may be substituted or unsubstituted, and aryl groups which may be substituted, and wherein said exposed photographic material is processed in a prebath or a color developer containing 10 mg/1 to 10 g/l of said formula [I] compound.

7 Claims, No Drawings

DIRECT POSITIVE IMAGE-FORMING PROCESS

This application is a continuation, of application Ser. No. 846,845, filed Apr. 1, 1986, now abandoned, which is a continuation, of application Ser. No. 693,794, filed Jan. 23, 1985, now abandoned, which is a continuation of application 457,490, filed Jan. 12, 1983 now abandoned, which, in turn, claims priority of Japanese application 2250/1982, filed Jan. 12, 1982.

This invention relates to a process for forming a direct positive image by the use of a direct positive photosensitive silver halide photographic material, and more particularly the invention is concerned with a process for obtaining a direct positive image on an internal latent image type photosensitive silver halide photographic material by imagewise exposing said photographic material to light and subjecting the imagewise exposed photographic material to surface development treatment associated with exposing said imagewise exposed photographic material to light all over the surface thereof.

Generally, it is well known that a direct positive image can be formed by the use of a photosensitive silver halide photographic material without necessitating intermediate treatment steps or a negative photographic image.

Processes hitherto known for forming a direct positive image using direct positive type photosensitive silver halide photographic materials can be divided, except for processes for special purposes, into mainly two types when taken their practical usefulness into consideration.

A process, one of the two types referred to above, is to obtain a positive image after development of a photosensitive material having a previously fogged silver halide emulsion by process in which an imagewise exposed photosensitive silver halide photographic emulsion is exposed to light of low intensity all over the surface thereof. According to this patent publication, it is reported that an excellent direct positive image with a high maximum density and a low minimum density can be obtained by the process claimed therein.

As a result of the present inventors' studies as the above-mentioned various problems associated with the light fogging procedure, it has been found that for obtaining a relatively favorable positive image, it is necessary to effect fogging exposure to light of a relatively low intensity of illumination within a certain limited range and, in that case, however, no sufficient maximum image density is obtained by exposure to light of an intensity lower than that of the above-mentioned range even when the exposure amount used is sufficient, while at the exposure to light of an intensity higher than that of said range the maximum density decreases and the minimum density increases in proportion to an increase in intensity, that is, there is such phenomenon as called ununiformity of intensity of illumination in the light fogging procedure.

The present inventors, after a further detailed studies, have found that there are sometimes the cases where no favorable positive color image found sufficiently satisfactory is obtained by such fogging procedure as relying only on the adjustment of intensity of illumination as aforesaid. That is, it has been found that a positive color image as prepared by the light fogging procedure has such defect that in a high density portion (shadow portion) thereof, the density is liable to variation because a uniform and definite light fogging exposure is not always effected owing to local ununiformity of the illuminance on the photosensitive emulsion layer at the time of light fogging or variation of illuminance of light source with the lapse of time, and thus no stable image is obtained.

The present inventors prosecuted extensive researches with the view of obviating such drawbacks as mentioned above, and have eventually accomplished the present invention. That is, it is an object of the present invention to provide a process for forming a direct positive color image using the light fogging procedure with the use of an internal latent image type direct positive photosensitive silver halide photographic material, according to which an excellent positive color image stable to variation of the illuminance at the time of light fogging is obtained.

Other objects of the present invention will be obvious from the contents of the specification hereinafter disclosed.

The above-mentioned object of the present invention is accomplished by a process for forming a direct positive image by imagewise exposing to light a direct positive photosensitive silver halide color photographic material having on a support thereof at least one silver halide emulsion layer containing internal latent image type silver halide crystals and a coupler, the surface of said silver halide crystals having not been fogged before the imagewise exposure, and then uniformly exposing the imagewise exposed photographic material to light all over the surface thereof before development or during development treatment step, characterized in that said imagewise exposed photographic material is exposed to light all over the surface thereof in the presence of a compound represented by the general formula [I], [II] or [III]. General formula [I]

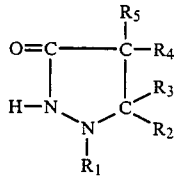

In the above formula, $R_1$ represents hydrogen, substituted or unsubstituted alkyl group of 1 to 4 carbon atoms, or substituted or unsubstituted aryl group (e.g. phenyl and tolyl group), $R_2$, $R_3$, $R_4$, and $R_5$ individually represent hydrogen, substituted or unsubstituted alkyl group of 1 to 4 carbon atoms, substituted or unsubstituted aryl group, or hydroxyl. Substituents for the aforesaid alkyl group include, for example, halogen, hydroxyl, carboxyl and amino group, and those for the aforesaid aryl group include, for example, halogen, alkyl, alkylamino, alkoxy and acylamino group. General formula [II]

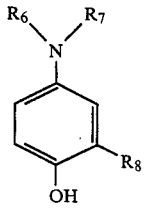

In the above formula, $R_6$ is hydrogen or alkyl group of 1 to 6 carbon atoms, and $R_7$ is hydrogen or alkyl group of 1 to 2 carbon atoms, which may be substituted with hydroxyl group, said $R_6$ and said $R_7$ may form, together with the attaching nitrogen atom, a nitrogen-containing heterocyclic ring, and said nitrogen-containing heterocyclic ring nucleus may contain oxygen. $R_8$ represents hydorgen, alkyl group of 1 to 2 carbon atoms, alkoxy or halogen. The nitrogen-containing heterocyclic ring nucleus which may be formed by said $R_6$ and said $R_7$ includes, for example, pyrrolidine, piperidine, piperazine, morpholine, etc. General formula [III]

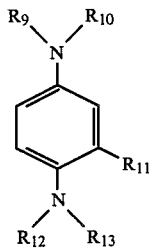

In the above formula, $R_9$, $R_{10}$, $R_{12}$ and $R_{13}$ individually represent substituted or unsubstituted alkyl group of 1 to 4 carbon atoms, or aralkyl group which may have a substituent having alkyl group of 1 to 4 carbon atoms. Said $R_9$ and said $R_{10}$, and said $R_{12}$ and said $R_{13}$, may individually form, together with the attaching nitrogen atom, a nitrogen-containing heterocyclic ring, said heterocyclic ring nucleus may contain oxygen. $R_{11}$ represents hydrogen, alkyl group or alkoxy group each having 1 to 2 carbon atoms, or halogen. The nitrogen-containing heterocyclic ring nuclei which may be formed by said $R_9$ and said $R_{10}$, and said $R_{12}$ and said $R_{13}$, include, for example, pyrrolidine, piperidine and morpholine.

Compounds represented by the aforesaid general formula [I] which are used in the present invention include those as exemplified below.

[Exemplified Compounds]

For instance, there may be mentioned 1-phenyl-3-pyrazolidone, 1-p-tolyl-3-pyrazolidone, 5phenyl-3-pyrazolidone, 5-methyl-3-pyrazolidone, 1-p-chlorophenyl-3-pyrazolidone, 1-phenyl-5-phenyl-3-pyrazolidone, 1-m-tolyl-3-pyrazolidone, 1-phenyl-5-methyl-3-pyrazolidone, 1-p-tolyl-5-phenyl-3-pyrazolidone, 1-p-methoxyphenyl-3-pyrazolidone, 1-acetamidophenyl-3-pyrazolidone, 1-phenyl-2-acetyl-4,4-dimethyl-3-pyrazolidone, 1-phenyl-4,4-dimethyl-3-pyrazolidone, 1-p-aminophenyl-4-methyl-4-propyl-3-pyrazolidone, 1-o-chlorophenyl-4-methyl-4-ethyl-3-pyrazolidone, 1-(p-β-hydroxyethylphenyl)-4,4-dimethyl-3-pyrazolidone, 1-p-hydroxyphenyl-4,4-dimethyl-3-pyrazolidone, 1-p-tolyl-4,4-dimethyl-3-pyrazolidone, 1-(7-hydroxy-2-naphthyl)-4-n-propyl-3-pyrazolidone, 1-p-diphenyl-4,4-dimethyl-3-pyrazolidone, 1-(p-β-hydroxyethylphenyl)-3-pyrazolidone, 1-o-tolyl-3-pyrazolidone, 1-o-tolyl-4,4-dimethyl-3-pyrazolidone, 1-phenyl-4-methyl-3-pyrazolidone, 4-hydroxy-4-methyl-1-phenyl-3-pyrazolidone, 4-hydroxymethyl-4-methyl-1-phenyl-3-pyrazolidone and 4,4-dihydroxymethyl-1-phenyl-3-pyrazolidone.

Compounds represented by the aforesaid general formula [II] or [III] which are used in the present invention include those as exemplified below.

[Exemplified Compounds]

For instance, there may be mentioned p-aminophenol, N-methyl-p-aminophenol, 4-hydroxy-3-methyl-N,N-diethylaniline, 4-hydroxy-3-methyl-N-ethyl-N-(β-hydroxyethyl)aniline, 4-hydroxy-3-methyl-N,N-dimethylaniline, 4-hydroxy-3-methyl-N-n-butyl-N-(β-hydroxyethyl)aniline, 4-hydroxy-3-methyl-N-(n-hexyl)-N-(β-hydroxyethyl)aniline, 4-hydroxy-3-methoxy-N,N-diethylaniline, N-(4-hydroxy-3-methyl-phenyl)pyrrolidine, N-(4-hydroxy-3-methyl-phenyl)piperidine, 4-hydroxy-3-(β-hydroxy-ethoxy)-N,N-diethylaniline, N-(4-hydroxyphenyl)piperazine, N-(4-hydroxyphenyl)-morpholin, N,N,N',N'-tetramethyl-p-phenylenediamine, N,N-dimethyl-N',N'-diethyl-p-phenylenediamine, N,N,N',N'-tetraethyl-p-phenylenediamine, N,N-dimethyl-N'-methyl-N'-ethyl-p-phenylenediamine, N-methyl-N-(β-methoxyethyl)-3-methyl-4-dimethylaminoaniline, N-(4-dimethylaminophenyl)morpholine, N-ethyl-N-(β-methanesulfonamidoethyl)-3-methyl-4-dimethylaminoaniline, N,N-dimethyl-3-methoxy-4-dimethylaminoaniline, N-(4-dimethylaminophenyl)piperazine, N-(4-dimethylaminophenyl)pyrrolidine, N,N-dimethyl-3-chloro-4-dimethylaminoaniline, N,N-diethyl-N',N'-di(β-hydroxyethyl)-p-phenylenediamine, and N,N-di(β-hydroxyethyl)-N',N'-di(β-methoxyethyl)-p-phenylenediamine.

In accordance with the present invention, it has been found that by exposing the imagewise exposed direct positive photosensitive silver halide photographic material as aforesaid to light all over the surface thereof in the presence of a compound represented by the aforesaid general formula [I], [II] or [III], before or during color development, with a relatively low intensity of illumination falling within a certain limited rage and under such conditions where reciprocity of illumination during light fogging less takes place so that fog nuclei are selectively formed only on the surface of unexposed silver halide crystals, and then subjecting the thus exposed photographic material to color development, thereby obtaining a positive image which is markedly stable to variation in the illuminance at the time when said imagewise exposed photographic material is exposed to light all over the surface thereof. So the present invention apparently differs from the process in which said the exposure to light all over the surface is carried out only in the presence of black and white developer or color developer to obtain a black and white image or color image.

Furthermore, the present invention is qualitatively different from a color reversal development process for obtaining a color image, wherein the imagewise exposed photographic material is subjected to silver development and thereby to form a latent image by reversal exposure on the remaining unexposed silver halide crystals, irrespective of the surface and interior thereof, and then subjected to color development to obtain a color image.

By the term ". . . exposing the imagewise exposed photographic material to light all over the surface thereof before development . . . " as used in the present invention is meant, for instance, that the whole surface exposure subsequent to the imagewise exposure is effected in a treatment bath (pre-bath) which is used prior to development. Into the said treatment bath, if necessary, reductive substances, alkali agents, inhibitors and desensitizing agents and the like can be incorporated. Similarly, on the one hand, the term ". . . exposing the imagewise exposed photographic material to light all over the surface thereof . . . during development treatment . . . " literally means that the whole surface exposure is effected at any time during color development treatment. In that case, however, this exposure is preferably effected at the initial stage of development from the viewpoint of shortening the development time and, in this case, the exposure is advantageously initiated after thorough permeation of the developer through emulsion layers.

In the present invention, a compound represented by the general formula [I], [II] or [III] may be used according to any procedures of incorporating the compound in the photosensitive material, pre-bath and color developer.

To the incorporation into the photosensitive material of a compound represented by the general formula [I], [II] or [III], applicable are various procedures hitherto known in the technical field concerned. The amount of the compound to be incorporated is 0.05–50 g, preferably 0.1–10 g per mole of silver halide. The amount of a compound of the general formula [I], [II] or [III] when it is incorporated into a pre-bath or into a color developer is usually 10 mg/l–10 g/l, preferably 20 mg/l–3 g/l. The compounds of the general formula [I], [II] and [III] may be used either alone or in combination of two or more.

The whole surface exposure, i.e. intensity of illumination of the light fogging, used in the present invention is preferably such an intensity as may not cause reciprocity of illumination at the time of light fogging, which is generally 0.01–2000 luxes, preferably 0.05–30 luxes, more preferably 0.1–5 luxes. Adjustment of this light fogging intensity of illumination may be effected by varying luminous intensity of a light source or utilizing the reduction of quantity of light by the use of various filters, the distance between the photosensitive material and light source, or the angle between the photosensitive material and light source. Furthermore, in order to shorten the light fogging exposure time, there can be adopted a light fogging procedure wherein the fogging is effected with a weak light at the initial stage of light fogging exposure and thereafter with light stronger than that used initially.

The light source used in the present invention may sufficiently be at least one light source having wavelength falling within the sensitive wavelength region of the photosensitive photographic material which is intended to be exposed thereto. As a light source for the exposure of photosensitive color photographic material, preferably used is at least one light source having a broad spectral distribution covering a visible ray region of 400–700 nm, and for this purpose a fluorescent lamp high in color rendering as disclosed in Japanese Patent Laid-Open-to-Public Publn. No. 17350/1981. Furthermore, there may be used a combination of two or more light sources different in luminescent distribution or color temperature, or various kinds of filters such as color temperature transforming filters.

By color developer as used in the present invention is meant a color developer which does not contain substantially any silver halide dissolving agent, and as a developer usable in an acid color developer there may be mentioned ordinary color developing agents. Preferable color developing agent includes aromatic primary amino compounds, typical of which are p-phenylenediamine and p-aminophenols. Concretely, such color developing agents include, for example, aminophenol, N-methyl-aminophenol, N,N-diethyl-phenylenediamine, 4-amino-3-methyl-N-ethyl-N-(β-methanesulfonamidoethyl)aniline, 4-amino-3-methyl-N-ethyl-N-(β-hydroxyethyl)aniline, 4-amino-3-methyl-N,N-diethyl-p-phenylenediamine and 4-amino-3-methyl-N-ethyl-N-β-methoxyethyl-p-phenylenediamine. These developing agents may individually be contained in advance into emulsions so that the agents act on silver halide during immersion of said agents in a high pH aqueous solution.

The amount of these aromatic primary amino compounds to be used is easily decided by experiment, though it may vary according to the kind of photosensitive color photographic material to be developed therewith. Generally, however, such compounds may be used in amounts of 0.002–0.7 mole per 1 liter of the developer.

The developer may contain specific antifoggants and development inhibitors, or alternatively these additives for developer may optionally be incorporated into constituent layers of the photosensitive photographic material. Usually, useful antifoggants include tetrazaindenes, benzotriazoles, benzimidazoles, benzothiazoles, benzooxazoles, such heterocyclic thiones as 1-phenyl-5-mercaptotetrazole, aromatic and aliphatic mercapto compounds.

In the present invention, particularly when tetrazaindenes are present, the tetrazaindenes interact with a compound of the aforesaid general formula [I], [II] or [III] present in the developer to display an effect of reducing variation of the image density caused by variation of illuminance at the time of light fogging. This effect obtained in that case is a synergistic effect of the two compounds. Preferable as tetrazaindenes are those which are represented by the following general formula [IV]. General formula [IV]

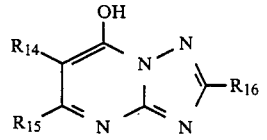

In the general formula [IV], $R_{14}$ and $R_{15}$ individually represent hydrogen, substituted or unsubstituted alkyl group of 1 to 4 carbon atoms, substituted or unsubstituted aryl group, or non-metal atomic groups necessary for forming by mutual linking a 5-membered or 6-membered ring, and $R_{16}$ represents hydrogen, substituted or unsubstituted alkyl group of 1 to 4 carbon atoms, or substituted or unsubstituted aryl group. Examples of tetrazaindenes which are advantageously usable in the present invention include 4-hydroxy-1,3,3a,7-tetrazaindene, 4-hydroxy-6-methyl-1,3,3a,7-tetrazaindene, 4-methyl-6-hydroxy-1,3,3a,7-tetrazaindene, 4-hydroxy-6-butyl-1,3,3a,7-tetrazaindene, 4-hydroxy-5,6-dimethyl-1,3,3a,7-tetrazaindene, 2-ethyl-4-hydroxy-6-propyl-1,3,3a,7-tetrazaindene, 2-allyl-4-hydroxy-1,3,3a,7-tetrazaindene, 4-hydroxy-6-phenyl-1,3,3a,7-tetrazaindene, 2-propyl-4-hydroxy-6-phenyl-1,3,3a,7-tetrazaindene, 2-mercaptomethyl-4-hydroxy-6-methyl-1,3,3a,7-tetrazaindene, 4-hydroxy-5,6-trimethylene-1,3,3a,7-tetrazaindene, etc. These tetrazaindenes may be used either alone or in combination of two or more, and the amount thereof to be incorporated into the color developer is preferably 10 mg/l–5 g/l The color developer incorporated with the tetrazaindenes may further be incorporated with commonly used various additives, for example, alkali agents such as sodium hydroxide, sodium carbonate and potassium carbonate, alkali metal sulfites, alkali metal bisulfites, alkali metal thiocyanates, alkali metal halides, benzyl alcohol, water softeners, thickeners and development accelerators. A pH value of this color developer is usually above 7, most generally about 9 to about 14.5, and more preferably 10 to 14.

Various other additives which are incorporated, if necessary, into the above-mentioned color developer include, for example, hydroxides, carbonates and phosphates of alkali metal and ammonium which are used for maintaining a pH value at a definite level, pH adjusting agents or buffer (e.g. such weak acids as acetic acid and boric acid, or weak bases, and salts thereof), and such development accelerators, for example as pyridinium compounds, cationic compounds, potassium nitrate, sodium nitrate, condensation products of polyethylene glycol, phenyl cellosolve, phenyl carbitol, alkyl cellosolve, dialkyl formamide, alkyl phosphates and derivatives thereof, nonionic compounds such as polythioethers, polymer compounds having sulfite esters, such organic amines as pyridine and ethanolamine.

The temperature of the color developer used in the present invention is usually 20°–70° C., preferably 30°–45° C.

In addition thereto, additives usable in the color developer used in the present invention include stain inhibitors, sludge inhibitors, accelerators for multilayer effect, and preservatives (e.g. sulfites, acid sulfites, hydroxylamine hydrochloride, form sulfites, alkanolamine sulfite adducts, etc.). As chelating agents, there may be mentioned phosphates such as polyphosphates, aminopolycarboxylic acids such as nitrotriacetic acid, 1–3-diamino-2-propanoltetraacetic acid, etc., oxycarboxylic acids such as citric acid, gluconic acid, etc., 1-hydroxyethylidene, 1,1-diphosphonic acid, etc. Lithium sulfate may be used in combination with the chelating agents, and the above-mentioned chelating agents may be used either singly or in combination.

The photosensitive material under treatment may be conveyed by various methods and accordingly various types of conveying apparatuses are employed therefor, for example, those of hanger type, cine-type and roller conveyer type.

When exposed photosensitive photographic materials are processed with an automatic developing machine, it has been a common practice to process said material with processing solutions while replenishing the replenishing solutions according to the photosensitive material under treatment. In the present invention, however, the replenishment of processing solution may be carried out by using kits of replenishing solutions comprising their respective liquid processing chemicals and separate kits adapted for individual processing steps. Furthermore, there may be used also a process for regenerating and reusing the used processing solutions, or a process recovering important chemicals such as developing agents, heavy metals, etc. as developed from the standpoint of pollution and/or recovery of resources, coupled with apparatuses into which any devices therefor have been incorporated.

Silver halide emulsions used in the photosensitive material of the present invention are those which contain any of silver halides, for example, silver bromide, silver chloride, silver chlorobromide, silver iodobromide and silver chloroiodobromide, the crystal surface of said silver halides has not been previously fogged, said silver halides forming latent images mainly in the interior of silver halide crystals and having most of sensitivity specks mainly in the interior of the crystals.

The internal latent image type silver halide crystals in accordance with the present invention is preferably not chemically sensitized, or if any, to a slight extent.

The meaning of the expression that the crystal surface of silver halide has not been previously fogged is that a density is not exceeding 0.6, preferably not exceeding 0.4, said density being obtained by developing without exposure with the following surface developer at 20° C. for 10 minutes a specimen obtained by coating the emulsion used in the present invention at a coverage of 35 mg Ag/dm$^2$ on a transparent film support.

| [Surface developer A] | |
|---|---|
| Methol | 2.5 g |
| l-Ascorbic acid | 10 g |
| $NaBO_2.4H_2O$ | 35 g |
| KBr | 1 g |
| Water to make 1 liter | |

The silver halide emulsions of the present invention are such that they give sufficient density when the above-mentioned specimen is exposed to light and then developed with the internal developer of the following composition.

| [Internal developer B] | |
|---|---|
| Methol | 2 g |
| Anhydrous sodium sulfite | 90 g |
| Hydroquinone | 8 g |
| Sodium carbonate (monohydrate) | 52.5 g |
| KBr | 5 g |
| Kl | 0.5 g |
| Water to make 1 liter | |

More particularly speaking, the present emulsions show the maximum density, which is obtained by light intensity scalewise exposing a part of the aforesaid specimen over a given period of time within about one second, followed by developing with the aforesaid internal developer B at 20° C. for 4 minutes, higher by at least 5 times, preferably at least 10 times than that obtained by exposing the remaining part of said specimen under the same conditions as above, followed by developing with the aforesaid surface developer A at 20° C. for 4 minutes.

Such silver halide emulsions usable in the present invention as mentioned above include, for example, conversion type silver halide emulsions as disclosed in U.S. Pat. No. 2,592,250, internally chemically sensitized nucleus type silver halide emulsions or core/shell type silver halide emulsions doped with polyvalent metal ions as disclosed in U.S. Pat. Nos. 3,761,266 and 3,761,276, layered structure type silver halide emulsions as disclosed in Japanese Patent Laid-Open-to-Public Publns. Nos. 8524/1975, 38525/1975 and 4208/1978, and such emulsions as disclosed in Japanese Patent Laid-Open-to-Public Publns. Nos. 156614/1977 and 127549/1980.

The silver halide emulsions used in the present invention may be optically sensitized with sensitizing dyes commonly used in the art. Combinations of sensitizing dyes used for the optical supersensitization of internal latent type silver halide emulsions, negative type silver halide emulsions, etc. are advantageously useful in the present silver halide emulsions. To sensitizing dyes reference can be made in the pertinent portion of Research Disclosure, No. 15162.

For keeping the surface sensitivity at a level as low as possible and giving a lower minimum density and more stable characteristics, the present silver halide emulsions may contain commonly used stabilizers, for example, compounds having azaindene ring and heterocyclic compounds having mercapto (respective representatives thereof are 4-hydroxy-6-methyl-1,3,3a,7-tetrazaindene and 1-phenyl-5-mercaptotetrazole).

In addition thereto, the present silver halide emulsions may contain such antifoggants or stabilizers, for example, as mercury compounds, triazole type compounds, azaindene type compounds, benzothiazolium type compounds, zinc compounds, etc.

Incorporation into the present silver halide emulsions of various photographic additives as mentioned hereinbefore is optional. Other additives which are used in the present invention according to the purpose thereof include wetting agents, for example, dihydroxy alkanes, etc., film property improving agents, for example, water-dispersible particulate high molecular substances obtained by emulsion polymerization, such as copolymers of alkyl acrylates or alkyl methacrylates and acrylic acid or methacrylic acid, styrene-maleic acid copolymers, and styrene-maleic anhydride half alkyl ester copolymers, and coating aids, for example, saponin, polyethylene glycol lauryl ether, etc. Optionally usable photographic additives other than those mentioned above include gelatin-plasticizing agents, surfactants, ultraviolet absorbers, pH adjusting agents, antioxidants, antistatic agents, viscosity increasing agents, granularity improving agents, dyes, mordants, whitening agents, development speed adjusting agents and matting agents.

Silver hlaide emulsions which have been prepared in the above-mentioned manner are coated on a support, if necessary through sub layer, antihalation layer, filter layer, etc., to obtain an internal latent image type photosensitive silver halide photographic material.

The photosensitive silver halide photographic material thus obtained have therein at least one of blue-sensitive, green-sensitive and red-sensitive emulsion layers for forming yellow, magenta and cyan dye images, respectively. Of color formers, i.e. couplers, usable in the above-mentioned specific emulsion yellow coupler includes open chain ketomethylene compounds, benzoyl acetanilide type yellow coupler, pivaroyl acetanilide type yellow couplers and 2-equivalent type yellow couplers having a substituent capable of releasing the carbon atom in the coupling position at the time of coupling reaction, magenta coupler includes compounds of such types as pyrazolone, pyrazolotriazol, pyrazolinobenzimidazole and indazolone, and cyan coupler includes generally phenol or naphthol derivative type compounds.

Advantageously usable are ultraviolet absorbers for the purpose of preventing dye images from fading due to actinic rays of short wavelength, said absorbers include, for example, thiazolidone, benzotriazole, acrylonitrile or benzophenone type compounds, particularly useful are Tinuvin PS, 320, 326, 327 and 328 (products of Chiba-Geigy) which may be used either alone or in combination.

Support for the present photosensitive materials may be any of usable support materials, typical of which are polyethylene terephthalate films, polycarbonate films, polystyrene films, cellulose acetate films, baryta paper, polyethylene-laminated paper and the like, said films or paper having been subbed if necessary.

The silver halide emulsions used in the present invention may contain gelatin as protective colloid or binder, and appropriate gelatin derivatives according to purposes other than the above. Such appropriate gelatin derivatives include acylated gelatin, guanidylated gelatin, carbamylated gelatin, cyanoethanolated gelatin, esterified gelatin, etc.

In the present invention, other appropriate hydrophilic binders may be contained, according to the purpose, in constituent layers of the present photosensitive material such as emulsion layers, intermediate layers, protective layers, filter layers, backing layer, etc., said appropriate hydrophilic binders include, besides gelatin, colloidal albumin, agar, gum arabic, dextran, alginic acid, cellulose derivatives hydrolized to an acetyl content of 19–20%, such as cellulose acetate, polyacrylamide, imidized polyacrylamide, casein, vinyl alcohol polymers containing uretanecarboxylic acid radical or cyanoacetyl group, such as vinyl alcohol-vinyl aminoacetate copolymers, polyvinyl alcohol, polyvinyl pyrolidone, hydrolized polyvinyl acetate, polymers obtained by polymerization of protein or saturated acylated protein and monomers having vinyl group, polyvinyl pyridine, polyvinyl amine, polyaminoethyl methacrylate and polyethylene amine. The above-mentioned appropriate hydrophilic binder may contain, according to the purpose, suitable plasticizers, lubricants and the like additives.

The constituent layers of the present photosensitive material can be hardened with any of suitable hardeners. These hardeners include chromium salts, zirconium salts, such aldehyde type, halotriazine type or polyepoxy type compounds as formaldehyde or mucohalogeno acid, and ethylene imine type, vinyl sulfone type or acryloyl type hardeners.

On the support of the present photosensitive material, there can be formed by coating a plurality of various photographic constituent layers such as emulsion layers, filter layers, intermediate layers, protective layers, sub layers, backing layers and antihalation layers.

The photosensitive materials used in the present invention are ordinary multilayer direct positive photosensitive color photographic materials which form dye images fundamentally of three colors, yellow, magenta and cyan as aforesaid. The present invention, however, can advantageously be applied to direct positive pseudocolor photosensitive materials and color photosensitive materials containing compounds capable of forming black image at the time of color development.

In this connection, the light fogging procedure in accordance with the present invention is also applicable to such direct positive color photosensitive materials which are designed that coupler and a color developing agent or color developing agent precursor are made present in the same one layer by protecting them so as to prevent them from contact with each other at the when said layer remains unexposed and they are brought into contact with each other after exposure, or such direct positive color photosensitive material which are so designed that a color developing agent or color developing agent precursor is contained in a layer containing no coupler, and when an alkaline processing solution is permeated through said layer, the resulting an alkali hydrolyzate of said color developing agent or said color developing precursor is moved to contact with couplers.

The present invention is illustrated below in detail with reference to examples, but it should be construed that embodiments of the invention are not limited thereto.

EXAMPLE 1

Sample 1 was prepared by successively coating the following layers in the order recited on a resin-coated paper support.

Following the procedure described in Example 1 or U.S. Pat. No. 2,592,250, an internal latent image type silver chloroiodobromide emulsion was prepared according to conversion method.

Layer 1 . . . Yellow forming blue-sensitive silver halide emulsion layer

A solution of a mixture of 120 g of α-[4-(1-benzyl-2-phenyl-3,5-dioxo-1,2,4-triazolidinyl)]-α-pivaryl-2-chloro-5-[γ-(2,4-di-tert-amylphenoxy)-butylamido]acetanilide as a yellow coupler, 3.5 g of 2,5-di-tert-octylhydroquinone, 200 g of paraffin, 100 g of Tinuvin (u.v. absorber produced and sold by Chiba-Geigy) and 100 g of dibutyl phthalate in 70 ml of ethyl acetate was dispersed in a gelatin solution containing sodium dodecylbenzenesulfonate and incorporated into the aforesaid internal latent image type silver chloroiodobromide emulsion. The emulsion was coated on the support at a silver coverage of 400 mg/m$^2$, and a coupler coverage of 400 mg/m$^2$.

Layer 2 . . . Protective layer

A gelatin solution was coated at a gelatin coverage of 200 mg/m$^2$ on the layer 1. Into the layer 1 were incorporated bis(vinylsulfonylmethyl)ether as a hardener and saponin as a coating aid.

The sample 1 was cut into twenty-five equal parts and wedgewise exposed to light using a xenon lamp, followed by treatments 1, 2, 3, 4 and 5.

[Treatment 1]

Light fogging bath (30 sec., and the light fogging exposure was effected for 10 sec. after immersion of the sample in a light fogging solution)→color development (2 min.)→bleach-fixing (1 min.)→water-washing (1 min.).

In each step, the processing temperature is 38° C., and the composition of each processing solution used is as indicated below.

[Composition of light fogging bath's solution]

The solution is composed of an aqueous solution of the following chemical at a concentration (g/l) as indicated.

| | |
|---|---|
| Potassium carbonate | 10.0 |
| pH (adjusted with potassium hydroxide and sulfuric acid) | 10.40 |

[Composition of color developer]

The developer is composed of an aqueous solution comprising the following chemicals at their respective concentrations (g/l) as indicated.

| | |
|---|---|
| Potassium carbonate | 28.9 |
| Potassium sulfite | 2.6 |
| Sodium bromide | 0.26 |
| Benzyl alcohol | 12.8 |
| Ethylene glycol | 3.4 |
| Hydroxylamine sulfate | 2.6 |
| Diaminopropanoltetraacetic acid | 0.09 |
| Sodium chloride | 3.2 |
| Nitrotriacetic acid | 0.4 |
| 3-Methyl-4-amino-N—ethyl-N—(β-methanesulfonamidoethyl) aniline sulfate | 5.0 |
| pH (adjusted with potassium hydroxide) | 10.40 |

[Composition of bleach-fixing solution]

The solution is composed of an aqueous solution of the following chemicals at their respective concentrations (g/l) as indicated.

| | |
|---|---|
| Ammonium thiosulfate | 110 |
| Sodium bisulfite | 10 |
| Ferric ammonium salt of ethylenediaminetetraacetic acid | 60 |
| Diammonium salt of ethylenediaminetetraacetic acid | 5 |
| Bisthiourea | 2 |
| pH (adjusted with ammonia water) | 6.5 |

In practicing the light fogging exposure, a tungsten lamp was used as a light source and intensity of illumination was varied at five stages by using neutral density filters to 0.3 lux, 0.6 lux, 1.2 lux, 1.8 lux and 2.4 lux, respectively, at the surface of the silver halide emulsion layer.

In the practice of the light fogging exposure, the sample was immersed for 10 seconds in the solution, the immersed sample was taken out of the solution and positioned horizontally so that the sample is exposed perpendicular to light, and after a 10 second exposure the sample was again immersed in the solution.

Treatments 2, 3, 4 and 5 were conducted in the same manner as in Treatment 1, except that the light fogging baths' solutions of Treatments 2, 3, 4 and 5 additionally contained 100 mg/l each of the following compounds (A), (B), (C) and (D), respectively.

(A) 1-Phenyl-3-pyrazolidone (B) 4-Hydroxymethyl-4-methyl-1-phenyl-3-pyrazolidone (C) N-Methyl-p-aminophenol (D) N,N,N',N'-tetramethyl-p-phenylenediamine The samples thus treated were individually tested for minimum and maximum densities of the image formed thereon to obtain the results as shown in Table 1.

As is clear from the results in Table 1, it is understood that positive yellow images stable to reciprocity of illumination in the light fogging exposure are obtained in Treatments 2, 3, 4 and 5 according to the present invention.

TABLE 1

| Treatment No. | Amount of light fogging exposure (C.M.S.) | Minimum density | Maximum density |
|---|---|---|---|
| 1 | 3 | 0.04 | 0.56 |
| (Comparative) | 6 | 0.06 | 1.07 |
| | 12 | 0.08 | 1.40 |
| | 18 | 0.10 | 1.25 |

TABLE 1-continued

| Treatment No. | Amount of light fogging exposure (C.M.S.) | Minimum density | Maximum density |
|---|---|---|---|
| | 24 | 0.15 | 0.89 |
| 2 | 3 | 0.04 | 1.21 |
| (Present | 6 | 0.04 | 1.37 |
| invention) | 12 | 0.04 | 1.48 |
| | 18 | 0.05 | 1.44 |
| | 24 | 0.09 | 1.30 |
| 3 | 3 | 0.04 | 1.13 |
| (Present | 6 | 0.04 | 1.38 |
| invention) | 12 | 0.05 | 1.44 |
| | 18 | 0.06 | 1.44 |
| | 24 | 0.09 | 1.40 |
| 4 | 3 | 0.05 | 1.03 |
| (Present | 6 | 0.05 | 1.21 |
| invention) | 12 | 0.05 | 1.35 |
| | 18 | 0.06 | 1.31 |
| | 24 | 0.08 | 1.27 |
| 5 | 3 | 0.04 | 1.23 |
| (Present | 6 | 0.04 | 1.39 |
| invention) | 12 | 0.04 | 1.45 |
| | 18 | 0.05 | 1.46 |
| | 24 | 0.08 | 1.36 |

EXAMPLE 2

The same sample as obtained in Example 1 was cut into forty-five equal parts which were subjected to wedgewise exposure with a xenon lamp and then subjected to the following Treatments 6, 7, 8, 9, 10, 11, 12, 13 and 14, respectively.

The following treatment step used was common to all Treatment 6, 7, 8, 9, 10, 11, 12, 13 and 14, and the light fogging bath's solution and color developer used were varied in composition in the manner as shown in Table 2A.

[Treatment step]

Light fogging bath (20 sec., and the light fogging exposure was effected for 10 sec. after a 10 sec. immersion of the sample in the light fogging bath)→stopping (30 sec.)→water-washing (30 sec.)→color development (2 min.)→bleach-fixing (1 min.)→water-washing (1 min.). Treatment temperature employed in each step is 38° C., and the composition of processing solution used in each step is as in the following.

[Light fogging bath . . . composition of blank solution]

The bath is composed of an aqueous solution of the following chemicals at their respective concentrations(g/l) as indicated.

| | |
|---|---|
| Potassium carbonate | 20.0 |
| Potassium sulfite | 2.6 |
| 3-Methyl-4-amino-N—ethyl-N—(β-methanesulfonamidoethyl) aniline sulfate | 5.0 |
| pH (adjusted with potassium hydroxide) | 10.40 |

[Composition of stopping solution]

The solution is composed of an aqueous solution of the following chemicals at their respective concentrations (g/l) as indicated.

| | |
|---|---|
| Acetic acid | 20.0 |
| Sodium sulfite | 5.0 |
| pH (adjusted with sodium hydroxide) | 4.0 |

[Composition of color developer. . . blank solution]

The developer has the same composition as that of Example 1.

[Composition of bleach-fixing solution]

The solution has the same composition as that of Example 1.

TABLE 2A

| Treatment No. | Composition of light fogging bath solution | Composition of color developer |
|---|---|---|
| 6 | Same as the blank. | To the blank was added 50 mg/l of 1-phenyl-3-pyrazolidone. |
| 7 | To the blank was added 50 mg/l of 1-phenyl-3-pyrazolidone. | Same as the blank. |
| 8 | To the blank was added 50 mg/l of 1-phenyl-3-pyrazolidone. | To the blank was added 50 mg/l of 1-phenyl-3-pyrazolidone. |
| 9 | Same as the blank. | To the blank was added 50 mg/l of N—methyl-p-aminophenol. |
| 10 | To the blank was added 50 mg/l of N—methyl-p-aminophenol. | Same as the blank. |
| 11 | To the blank was added 50 mg/l of N—methyl-p-aminophenol. | To the blank was added 50 mg/l of N—methyl-p-aminophenol |
| 12 | Same as the blank. | To the blank was added 50 mg/l of N,N,N',N'—tetramethyl-p-phenylenediamine. |
| 13 | To the blank was added 50 mg/l of N,N,N',N'—tetramethyl-p-phenylenediamine. | Same as the blank. |
| 14 | To the blank was added 50 mg/l of N,N,N',N'—tetramethyl-p-phenylenediamine. | To the blank was added 50 mg/l of N,N,N',N'—tetramethyl-p-phenylenediamine. |

The samples thus treated were individually tested for minimum and maximum densities of their respective images as formed thereon to obtain the results as shown in Table 2B.

As is clear from the relation between Treatments 6 and 7, 9 and 10, and 12 and 13, respectively, in Table 2B, it is understood that positive images stable to reciprocity of illumination can be obtained according to the process of the present invention which comprises effecting the light fogging exposure in the presence of 1-phenyl-3-pyrazolidone, N-methyl-p-aminophenol or N,N,N',N'-tetramethyl-p-phenylenediamine. As is clear from the relation between Treatments 7 and 8, 10 and 11, and 13 and 14, respectively, moreover, it is understood that the stabilizing effect on reciprocity of illumination at the time of light fogging exposure of 1-phenyl-3-pyrazolidone, N-methyl-o-aminophenol or N,N,N',N'-tetramethyl-p-phenylenediamine is advantageously displayed at the time of the light fogging step.

TABLE 2B

| Treatment No. | Amount of light fogging exposure (CMS) | Minimum density | Maximum density |
|---|---|---|---|
| 6 | 3 | 0.04 | 2.07 |
| (Comparative) | 6 | 0.04 | 2.48 |
| | 12 | 0.06 | 2.68 |
| | 18 | 0.07 | 2.60 |
| | 24 | 0.10 | 2.45 |
| 7 | 3 | 0.04 | 2.54 |
| (Present | 6 | 0.04 | 2.63 |
| invention) | 12 | 0.05 | 2.69 |
| | 18 | 0.06 | 2.68 |
| | 24 | 0.08 | 2.60 |
| 8 | 3 | 0.04 | 2.61 |
| (Present | 6 | 0.04 | 2.66 |
| invention) | 12 | 0.04 | 2.69 |
| | 18 | 0.06 | 2.69 |
| | 24 | 0.08 | 2.64 |
| 9 | 3 | 0.04 | 2.13 |
| (Comparative) | 6 | 0.04 | 2.42 |
| | 12 | 0.04 | 2.64 |
| | 18 | 0.05 | 2.65 |
| | 24 | 0.07 | 2.47 |
| 10 | 3 | 0.04 | 2.51 |
| (Present | 6 | 0.04 | 2.60 |
| invention) | 12 | 0.04 | 2.69 |
| | 18 | 0.05 | 2.66 |
| | 24 | 0.07 | 2.60 |
| 11 | 3 | 0.04 | 2.59 |
| (Present | 6 | 0.04 | 2.63 |
| invention) | 12 | 0.04 | 2.68 |
| | 18 | 0.05 | 2.66 |
| | 24 | 0.07 | 2.60 |
| 12 | 3 | 0.04 | 2.20 |
| (Comparative) | 6 | 0.04 | 2.42 |
| | 12 | 0.04 | 2.60 |
| | 18 | 0.05 | 2.62 |
| | 24 | 0.07 | 2.51 |
| 13 | 3 | 0.04 | 2.52 |
| (Present | 6 | 0.04 | 2.61 |
| invention) | 12 | 0.04 | 2.64 |
| | 18 | 0.05 | 2.63 |
| | 24 | 0.07 | 2.60 |
| 14 | 3 | 0.04 | 2.56 |
| (Present | 6 | 0.04 | 2.61 |
| invention) | 12 | 0.05 | 2.63 |
| | 18 | 0.06 | 2.63 |
| | 24 | 0.07 | 2.60 |

EXAMPLE 3

Sample II was prepared by coating the following layers successively in the order recited on a resin-coated paper support.

Layer 1 . . . Cyan forming red-sensitive silver halide emulsion layer

Following the procedure disclosed in Japanese Patent Laid-Open-to-Public Publn. No. 127549/1980, an internal latent image type silver halide emulsion was prepared. That is, into 220 ml of a 1 mole potassium chloride aqueous solution containing 10 g of gelatin was quickly incorporated at 60° C. 200 ml of a 1 mole silver nitrate aqueous solution. The resulting mixture, after a 10-minute physical ripening, was incorporated with a mixed solution of 200 ml of a 1 mole potassium bromide aqueous solution and 50 ml of a 0.1 mole potassium iodide aqueous solution. Into the resulting mixture was incorporated over a period of 5 minutes 150 ml of a 1 mole silver nitrate aqueous solution in order to cover the obtained conversion type silver chloroiodobromide crystals with silver chloride shells, followed by a 20-minute physical ripening and then water-washing.

A solution of a mixture of 70 g of 2,4-dichloro-3-methyl-6-[α-(2,4-di-tert-amylphenoxy)butylamido]-phenol as a cyan coupler, 2 g of 2,5-di-tert-octylhydroquinone and 50 g of dibutyl phthalate in 140 g of ethyl acetate was dispersed by emulsification in a gelatin solution containing sodium isopropylnaphthalenesulfonate.

Subsequently, the dispersion thus obtained was incorporated into the aforesaid emulsion which had previously been subjected to spectral sensitization with the undermentioned dyes, the emulsion was incorporated with 1 g of potassium 2,5-dihydroxy-4-sec-octadecylbenzenesulfonate and with bis(vinylsulfonylmethyl)ether as a hardener. The emulsion was then coated on the support at a silver coverage of 400 mg/m$^2$ and a coupler coverage of 460 mg/m$^2$.

Dyes:

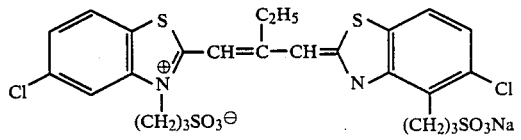

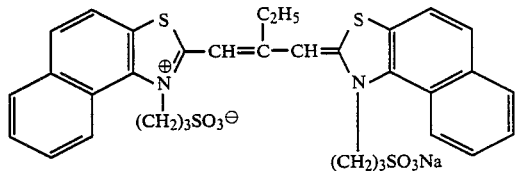

Layer 2 . . . Intermediate layer 100 ml of a 2.5% gelatin solution containing 5 g of grey colloidal silver and a dispersion of 10 g of 2,5-di-tert-octylhydroquinone in dibutyl phthalate was coated at a colloidal silver coverage of 400 mg/m$^2$ on the layer 1.

Layer 3 . . . Magenta forming green-sensitive silver halide emulsion layer

A solution of a mixture of 40 g of 1-(2,4,6-trichlorophenyl)-3-(2-chloro-5-octadecylsuccinimidoanilino)-5-pyrazolidone as a magenta coupler, 1 g of 2,5-di-tert-octylhydroquinone and 75 g of dioctyl phthalate in 30 g of ethyl acetate was dispersed by emulsification in a gelatin solution containing sodium isopropylnaphthalenesulfonate. The thus obtained dispersion was incorporated into the aforesaid emulsion which had previously been subjected to spectral sensitization with the under-mentioned dyes, the emulsion was incorporated with 1 g of potassium 2,5-dihydroxy-4-sec-octadecylbenzenesulfonate, and with bis(vinylsulfonylmethyl)ether as a hardener. The emulsion was then coated at a silver coverage of 400 mg/m$^2$ and a coupler coverage of 400 mg/m$^2$ on the layer 2.

Dyes:

-continued

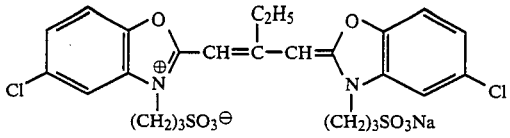

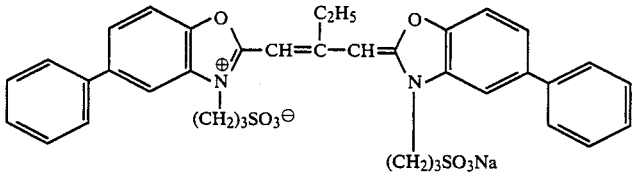

Layer 4 . . . Yellow filter layer

A 2.5% gelatin solution containing 5 g of yellow colloidal silver and 5 g of a dispersion of 2,5-di-tert-octylhydroquinone in dibutyl phthalate was coated at a colloidal silver coverage of 200 mg/m$^2$ on the layer 3.

Layer 5 . . . Yellow forming blue-sensitive silver halide emulsion layer

A solution of a mixture of 80 g of α-[4-(1-benzyl-2-phenyl-3,5-dioxo-1,2,4-triazolidinyl)]-α-pivaryl-2-chloro-5-[γ-(2,4-di-tert-amylphenoxy)-butylamido]acetanilide as a yellow coupler, 1 g of 2,5-di-tert-octylhydroquinone and 80 g of dibutyl phthalate in 200 g of ethyl acetate was dispersed by emulsification in a gelatin solution containing sodium isopropylnaphthalenesulfonate. The thus obtained dispersion was incorporated into the aforesaid emulsion, the emulsion was incorporated with 1 g of potassium 2,5-dihydroxy-4-sec-octadecylbenzenesulfonate, and with bis(vinylsulfonylmethyl)ether as a hardener. The emulsion was then coated at a silver coverage of 400 mg/m$^2$ and a coupler coverage of 530 mg/m$^2$ on the layer 4.

Layer 6 . . . Protective layer

A gelatin solution was coated at a gelatin coverage of 200 mg/m$^2$ on the layer 5.

In each of the layers 1, 2, 3, 4, 5 and 6 was contained saponin as a coating aid.

Sample II obtained in the manner as mentioned above was cut into twenty-five equal parts which were then subjected to wedgewise exposure with a xenon lamp, followed by Treatments 15, 16, 17, 18 and 19, respectively, in the manner as mentioned below.

[Treatment 15]

Color development (1 min. 30 sec., the light fogging exposure was effected for 10 sec. after immersion in the developer of the sample)→bleach-fixing (1 min.)→water-washing (1 min.). In each step, the temperature employed is 38° C., and the processing solution used in the bleach-fixing step has the same composition as that of the solution used in Example 1.

The light fogging exposure was effected in the same manner as in Example 1, except that a photographic reflection type blue incandescent lamp (Ra: 94) was used as a light source, and the sample was exposed to light for 10 seconds by horizontally holding said sample after a 10-second immersion thereof in the developer at a position in said developer 1 cm beneath the liquid surface, so that the light is casted perpendicular to the surface of the photosensitive layer of the sample.

Treatments 16, 17, 18 and 19 were conducted in the same manner as in Treatment 15, except that the undermentioned compounds (E), (F), (G) and (H), each 50 mg/l, were individually incorporated into the developers used in Treatments 16, 17, 18 and 19, respectively.

(E) 1-Phenyl-4,4-dimethyl-3-pyrazolidone (F) 4-Hydroxy-3-methyl-N,N-diethylaniline (G) N-(4-Hydroxyphenyl)morpholin (H) N-(4-dimethylaminophenyl)pyrrolidine The samples thus treated were tested for minimum and maximum densities of yellow (Y), magenta (M) and cyan (C), respectively, to obtain the results as shown in Table 3.

As is clear from the results shown in Table 3, it is understood that color image stable to reciprocity of illumination at the time of light fogging exposure can be obtained in Treatments 16, 17, 18 and 19 according to the present invention.

TABLE 3

| Treatment No. | Amount of light fogging exposure (C.M.S.) | Minimum density | | | Maximum density | | |
|---|---|---|---|---|---|---|---|
| | | Y | M | C | Y | M | C |
| 15 (Comparative) | 3 | 0.07 | 0.04 | 0.03 | 2.29 | 2.43 | 2.52 |
| | 6 | 0.07 | 0.04 | 0.03 | 2.62 | 2.63 | 2.69 |
| | 12 | 0.07 | 0.05 | 0.03 | 2.79 | 2.74 | 2.76 |
| | 18 | 0.08 | 0.05 | 0.03 | 2.64 | 2.70 | 2.71 |
| | 24 | 0.11 | 0.06 | 0.04 | 2.47 | 2.56 | 2.60 |
| 16 (Present invention) | 3 | 0.07 | 0.04 | 0.03 | 2.67 | 2.76 | 2.73 |
| | 6 | 0.07 | 0.04 | 0.03 | 2.79 | 2.83 | 2.78 |
| | 12 | 0.07 | 0.04 | 0.03 | 2.83 | 2.88 | 2.84 |
| | 18 | 0.08 | 0.05 | 0.03 | 2.82 | 2.88 | 2.82 |
| | 24 | 0.09 | 0.05 | 0.04 | 2.76 | 2.85 | 2.79 |
| 17 (Present invention) | 3 | 0.07 | 0.04 | 0.03 | 2.63 | 2.58 | 2.66 |
| | 6 | 0.07 | 0.04 | 0.03 | 2.71 | 2.68 | 2.71 |
| | 12 | 0.07 | 0.04 | 0.03 | 2.78 | 2.73 | 2.76 |
| | 18 | 0.08 | 0.05 | 0.03 | 2.78 | 2.73 | 2.76 |
| | 24 | 0.09 | 0.05 | 0.03 | 2.68 | 2.71 | 2.73 |
| 18 (Present invention) | 3 | 0.07 | 0.04 | 0.03 | 2.67 | 2.66 | 2.64 |
| | 6 | 0.07 | 0.04 | 0.03 | 2.77 | 2.72 | 2.70 |
| | 12 | 0.07 | 0.05 | 0.03 | 2.80 | 2.76 | 2.73 |
| | 18 | 0.07 | 0.05 | 0.03 | 2.78 | 2.76 | 2.73 |
| | 24 | 0.09 | 0.06 | 0.03 | 2.74 | 2.75 | 2.68 |
| 19 (Present-invention) | 3 | 0.07 | 0.04 | 0.03 | 2.66 | 2.71 | 2.68 |
| | 6 | 0.07 | 0.04 | 0.03 | 2.75 | 2.78 | 2.74 |
| | 12 | 0.07 | 0.04 | 0.03 | 2.78 | 2.80 | 2.77 |
| | 18 | 0.07 | 0.04 | 0.03 | 2.76 | 2.78 | 2.74 |
| | 24 | 0.08 | 0.05 | 0.03 | 2.74 | 2.76 | 2.71 |

EXAMPLE 4

Sample II of Example 3 was cut into twenty equal parts which were then subjected to wedgewise exposure with a xenon lamp, followed by Treatments 20, 21, 22, 23 and 24 in the manner as mentioned below.

Treatments 20, 21, 22, 23 and 24 were conducted in the same manner as in Treatments 15–19 of Example 3, except that the developers of Treatments 21–24 respectively contained 50 mg/l of 4-hydroxy-6-methyl-1,3,3a,6-tetrazaindene.

The samples thus treated were tested for minimum and maximum densities of yellow (Y), magenta (M) and cyan (C), respectively, to obtain the results as shown in Table 4.

As is clear from the results shown in Table 4, it is understood that color images stable to reciprocity of illumination at the time of light fogging exposure can be obtained in Treatments 21, 22, 23 and 24 according to the present invention.

TABLE 4

| Treatment No. | Amount of light fogging exposure (C.M.S.) | Minimum density Y | M | C | Maximum density Y | M | C |
|---|---|---|---|---|---|---|---|
| 20 (Comparative) | 3 | 0.07 | 0.04 | 0.03 | 2.31 | 2.46 | 2.53 |
| | 6 | 0.07 | 0.04 | 0.03 | 2.63 | 2.63 | 2.69 |
| | 12 | 0.07 | 0.04 | 0.03 | 2.78 | 2.74 | 2.75 |
| | 18 | 0.07 | 0.05 | 0.03 | 2.65 | 2.72 | 2.70 |
| | 24 | 0.08 | 0.05 | 0.04 | 2.48 | 2.58 | 2.59 |
| 21 (Present invention) | 3 | 0.07 | 0.04 | 0.03 | 2.78 | 2.83 | 2.81 |
| | 6 | 0.07 | 0.04 | 0.03 | 2.81 | 2.85 | 2.81 |
| | 12 | 0.07 | 0.04 | 0.03 | 2.82 | 2.86 | 2.82 |
| | 18 | 0.07 | 0.04 | 0.03 | 2.82 | 2.85 | 2.82 |
| | 24 | 0.07 | 0.04 | 0.04 | 2.81 | 2.84 | 2.83 |
| 22 (Present invention) | 3 | 0.07 | 0.04 | 0.03 | 2.78 | 2.81 | 2.75 |
| | 6 | 0.07 | 0.04 | 0.03 | 2.79 | 2.82 | 2.76 |
| | 12 | 0.07 | 0.04 | 0.03 | 2.80 | 2.83 | 2.76 |
| | 18 | 0.07 | 0.04 | 0.03 | 2.80 | 2.82 | 2.77 |
| | 24 | 0.08 | 0.04 | 0.03 | 2.79 | 2.77 | 2.75 |
| 23 (Present invention) | 3 | 0.07 | 0.04 | 0.03 | 2.76 | 2.76 | 2.73 |
| | 6 | 0.07 | 0.04 | 0.03 | 2.78 | 2.76 | 2.74 |
| | 12 | 0.07 | 0.04 | 0.03 | 2.79 | 2.76 | 2.74 |
| | 18 | 0.07 | 0.05 | 0.03 | 2.79 | 2.76 | 2.73 |
| | 24 | 0.08 | 0.05 | 0.03 | 2.76 | 2.78 | 2.72 |
| 24 (Present invention) | 3 | 0.07 | 0.04 | 0.03 | 2.78 | 2.74 | 2.75 |
| | 6 | 0.07 | 0.04 | 0.03 | 2.79 | 2.76 | 2.76 |
| | 12 | 0.07 | 0.04 | 0.03 | 2.80 | 2.78 | 2.76 |
| | 18 | 0.07 | 0.04 | 0.03 | 2.79 | 2.78 | 2.77 |
| | 24 | 0.07 | 0.04 | 0.03 | 2.79 | 2.78 | 2.76 |

What is claimed is:

1. A process for forming a direct positive color image comprising (a) imagewise exposing a direct positive photosensitive silver halide color photographic material to light to yield an imagewise exposed material, said photographic material having a support and at least one silver halide emulsion layer thereon, said emulsion layer containing a coupler and internal latent image type silver halide crystals whose surfaces have not been fogged prior to said imagewise exposure, and (b) uniformly exposing to light the entire surface of said imagewise exposed photographic material before or during a development step and in the presence of a substance of Formula IV, a compound of Formula I and a color-developing agent consisting of aromatic primary amino compounds selected from the group consisting of N-methyl-aminophenol, 4-amino-3-methyl-N-ethyl-N-(β-methanesulfonamidoethyl) aniline,4-amino-3-methyl-N-ethyl-N-(β-hydroxyethyl) aniline,4-amino-3-methyl-N,N-diethyl-p-phenylenediamine, and 4-amino-3-methyl-N-ethyl-N-β-methoxyethyl-p-phenylenediamine; wherein the oxidized products thereof form a coupling reaction with said couplers to produce dyes,

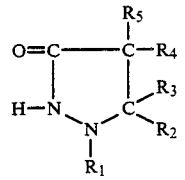

I wherein $R_1$ is selected from hydrogen, alkyls of 1 to 4 carbon atoms which are substituted or unsubstituted, and aryls which are substituted or unsubstituted; $R_2$–$R_5$ are individually selected from the same group as $R_1$ and hydroxyl;

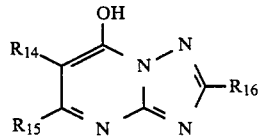

IV wherein $R_{14}$ and $R_{15}$ are individually selected from hydrogen, alkyls having 1 to 4 carbon atoms which may be substituted or unsubstituted, aryl groups which may be substituted or unsubstituted and non-metal atoms necessary for linking $R_{14}$ and $R_{15}$ in such a manner as to create 5 or 6 membered ring, and $R_{16}$ is selected from hydrogen, alkyls having 1 to 4 carbon atoms which may be substituted or unsubstituted, and aryl groups which may be substituted, and wherein said exposed photographic material is processed in a prebath or a color developer containing 10 mg/l to 10 g/l of said formula compound.

2. A process for forming a direct positive image according to claim 1 wherein the exposure of all over the surface of said photographic material (hereinafter referred as the whole surface exposure) during development step is carried out at the initial stage of the development step.

3. A process for forming a direct positive image according to claim 1 wherein the intensity of the whole surface exposure is 0.01–2,000 luxes.

4. A process for forming a direct positive image according to claim 1 wherein the amount of the tetrazaindene to be incorporated into a color developer is 20 mg/l–5 g/l.

5. A process for forming a direct positive image according to claim 1 wherein said previously unfogged silver halide crystals have a density not exceeding 0.6 which is obtained by developing without exposure with a surface developer at 20° C. for 10 minutes a specimen obtained by coating the silver halide emulsion at a coverage of 35 mg Ag/dm$^2$ on a transparent film support said

| said surface developer | |
|---|---|
| Methol | 2.5 g |
| l-Ascorbic acid | 10 g |
| $NaBO_2 \cdot 4H_2O$ | 35 g |
| KBr | 1 g |
| Water to make 1 liter | |

6. A process for forming a direct positive image according to claim 1 wherein an additional amount of said compound is incorporated into the photosensitive material in an amount of 0.05–50 grams per mole of silver halide.

7. A process for forming a direct positive image by imagewise exposing to light a direct positive photosensitive silver halide color photographic material having a support and at least one silver halide emulsion layer thereon, said emulsion layer containing internal latent image type silver halide crystals and a coupler, the surface of said silver halide crystals having not been fogged before the imagewise exposure, and then uniformly exposing the imagewise exposed photographic material to light all over the surface thereof before development or during a development step, characterized in that said imagewise exposed photographic material is exposed to light all over the surface thereof in the presence of a substance represented by the general formula,

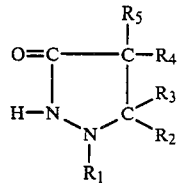

I wherein $R_1$ represents hydrogen, substituted or unsubstituted alkyl group of 1 to 4 carbon atoms, or substituted or unsubstituted aryl group, $R_2$, $R_3$, $R_4$ and $R_5$ individually represent hydrogen, substituted or unsubstituted alkyl group of 1 to 4 carbon atoms, substituted or unsubstituted aryl group, or hydroxyl group, and a color developing agent consisting of aromatic primary amino compounds selected from the group consisting of N-methyl-aminophenol, 4-amino-3-methyl-N-ethyl-N-(β-methanesulfonamidoethyl) aniline,4-amino-3-methyl-N-ethyl-N-(β-hydroxyethyl) aniline,4-amino-3-methyl-N,N-diethyl-p-phenylenediamine, and 4-amino-3-methyl-N-ethyl-N-β-methoxyethyl-p-phenylenediamine; wherein said exposed photographic material is processed in a prebath or a color developer containing 10 mg/l to 10 g/l of said formula compound.

* * * * *